US006009388A

United States Patent [19]

Ozawa

[11] Patent Number: 6,009,388

[45] Date of Patent: Dec. 28, 1999

[54] HIGH QUALITY SPEECH CODE AND CODING METHOD

[75] Inventor: Kazunori Ozawa, Tokyo, Japan

[73] Assignee: NEC Corporation, Japan

[21] Appl. No.: 08/991,320

[22] Filed: Dec. 16, 1997

[30] Foreign Application Priority Data

Dec. 18, 1996 [JP] Japan ..... 8-338647

[51] Int. Cl.[6] ..... G10L 9/14

[52] U.S. Cl. ..... 704/223; 704/230

[58] Field of Search ..... 704/200, 219, 704/221, 223, 222, 220, 230, 224

[56] References Cited

U.S. PATENT DOCUMENTS

| | | | |
|---|---|---|---|
| 5,261,027 | 11/1993 | Taniguchi et al. | 704/223 |
| 5,465,316 | 11/1995 | Tanaka | 704/219 |
| 5,884,253 | 3/1999 | Kleijn | 704/200 |

FOREIGN PATENT DOCUMENTS

| | | | |
|---|---|---|---|
| 0582921 | 2/1994 | European Pat. Off. | G10L 9/14 |
| 0718822 | 6/1996 | European Pat. Off. | G10L 3/00 |
| 4171500 | 2/1990 | Japan . | |
| 4344699 | 3/1991 | Japan . | |
| 4363000 | 3/1991 | Japan . | |

OTHER PUBLICATIONS

M.R. Schroeder, et al., "Code–Excited Linear Prediction (CELP): High–Quality Speech at Very Low Bit Rates", Proc. ICASSP, 1985, pp. 937–940.

W.B. Kleijn, et al., "Improved Speech Quality and Efficient Vector Quantization is SELP", Proc. ICASSP, 1988, pp. 155–158.

J–H. Chen, et al., "A Low–Delay CELP Coder for the CCITT 16 kb/s Speech Coding Standard", IEEE Journal on Selected Areas in Communications, vol. 10, No. 5, Jun. 1992, pp. 830–849.

Nakazimo, "Signal Analysis and System Identification", issued by Corona Co., Ltd., 1988, pp. 82–87.

P. Kroon, et al., "Pitch Predictors With High Temporal Resolution", Proc. ICASSP, 1990, pp. 661–664.

N. Sugamura, et al., "Speech Data Compression by LSP Speech Analysis–Synthesis Technique", The Transactions of Institute of Electronics and Communication Engineers of Japan, vol. J64–A, No. 8, 1981, pp. 599–606.

T. Nomura, et al., "LSP Coding Using VQ–SVQ With Interpolation in 4.075 KBPS M–LCELP Speech Coder", Proc. Mobile Multimedia Communications, 1993, pp. B.2.5–1–B.2.5–4.

"A Fixed–Point 16 KB/S LD–CELP Algorithm", Juin–Hwey Chen et al., ICASSP–91: IEEE International Conference on Acoustics, Speech and Signal Processing, vol. 1, 14–17, May 1991, pp. 21–24.

"A Low–Delay CELP Coder for the CCITT 16 kb/s Speech Coding Standard", Juin–Hwey Chen et al., IEEE Journal on Selected Areas in Communications, vol. 10, No. 5, Jun. 1, 1992, pp. 830–849.

*Primary Examiner*—Richemond Dorvil

*Attorney, Agent, or Firm*—Ostrolenk, Faber, Gerb & Soffen, LLP

[57] ABSTRACT

A first coefficient generating unit derives, from a past speech reproduction signal, a first coefficient signal representing a spectral characteristic of the past speech reproduction signal. A residual signal generating unit derives, from a speech signal for each frame, a predicted residue signal by using the first coefficients. A second coefficient generator derives second coefficients representing a spectral characteristic of the predicted residue signal. A second coefficient quantizing unit quantizes the second coefficients and provides a quantized coefficient signal. An excitation quantizing unit derives an excitation signal concerning the speech signal by using the speech signal, the first coefficient signal, the second coefficient signal and the quantized coefficient signal, quantizes the excitation signal thus derived and provides a quantized excitation signal. A signal generating unit reproduces a speech reproduction signal of the particular frame by using the first coefficient signal, the quantized coefficient signal and the quantized excitation signal.

20 Claims, 7 Drawing Sheets

HIGH QUALITY SPEECH CODE AND CODING METHOD

BACKGROUND OF THE INVENTION

1. Field of the Invention

The present invention relates to a speech coder for the high quality coding of an input speech signal at low bit rates.

2. Related Art

Well-known systems for high quality coding input speech signal, CELP (Code Excited Linear Predictive Coding), are disclosed in (i) M. Schroeder and B. Atal, "Code-Excited Linear Prediction: High Quality Speech At Very Low Bit Rates", Proc. ICASSP, pp. 937–940, 1985 (hereinafter referred to as "Literature 1"), and (ii) Kleij et al; "Improved speech quality and efficient vector quantization in SELP", Proc. ICASSP, pp. 155–158, 1988 (hereinafter referred to as "Literature 2").

On the transmitting side of such a coding system, spectral parameters representing spectral characteristics of a speech signal are extracted from the same kusing linear predictive (LPC) analysis of a predetermined degree (for instance, the 10-th degree), and quantized to provide quantized parameters. Each frame of the speech signal is divided into a plurality of sub-frames (for instance of 5 ms) and codebook parameters (a delay parameter and a gain parameter corresponding to the pitch cycle) are extracted for each sub-frame on the basis of a past excitation signal in accordance with the spectral parameters. In addition, a sub-frame speech signal is predicted using pitch prediction with reference to an adaptive codebook.

The excitation signal thus obtained through the pitch prediction is then quantized by selecting an optimum excitation codevector from an excitation codebook (or vector quantization codebook) which is constituted by predetermined kinds of noise signals and by calculating an optimum gain. The selection of the excitation codevector is performed such that error power is minimized between a signal synthesized from the selected noise signals and a residue signal. An index indicative of the kind of codevector selected, a gain, quantized spectral parameters and extracted adaptive codebook parameters are multiplexed in a multiplexer and the resultant multiplexed data is transmitted. The receiving side is not described.

The method of improving the analysis accuracy of the speech signal spectral parameter on the basis of the CELP, has already been proposed. Indeed, on the transmitting side, spectral parameters of a reproduced speech signal are developed by analyzing past reproduced speech signals to a higher degree than is conventional and are used to quantize the speech. This method is known as LD-CELP (Low-Delay CELP) and is described in, for instance, J-H Chen et al, "A Low-Delay CELP Coder For The CCITT 16 kb/s Speech Coding Standard", IEEE Journal of Selected Areas on Communications, vol. 10, pp. 830–849, June 1992 (hereinafter referred to as "Literature 3"). In a LD-CELP system, on the receiving side as well as the transmitting side, spectral parameters are developed and used based on analysis of the past reproduced speech signal. This provided an advantage in that no spectral parameter needed to be transmitted even when the degree of analysis is greatly increased.

Such a well-known speech coding/decoding method is disclosed in, for example, Laid-Open Patent 4-344699.

In the speech coding methods disclosed in Literatures 1 and 2, since the spectral parameters are analyzed with a constant degree (for example, the 10-degree) for each frame, if the analysis degree is increased by two times (i.e., to for example, the 20-degree) in order to increase the spectral analysis degree, twice the number of transmission bits are required, thereby increasing the bit rate.

The speech coding method disclosed in Literature 3 requires that the analysis degree be increased to transmit the speech parameters. The spectral parameter matching is degraded at portions where the signal characteristic is changed with time, thereby degrading the characteristic and speech quality. This is due to the use of the spectral parameters analyzed from the past produced signal. In particular, the increase in the analysis degree degrades the matching characteristic of the reproduced signal developed on the transmission side and the reproduced signal on the received side. Therefore, when error is caused on the transmission side, the speech quality on the receiving side is remarkably degraded because of mismatching between the reproduced signal obtained from the reproduced signals on the transmission side and the receiving side.

SUMMARY OF THE INVENTION

An object of the present invention is, therefore, to provide a speech coder and coding method capable of improving speech quality using a relatively small amount of calculations.

According to an aspect of the present invention, there is provided a speech coder comprising a divider for dividing an input speech signal into a plurality of frames having a predetermined time length, a first coefficient analyzing unit for deriving first coefficients representing a spectral characteristic of a past reproduced signal from the reproduced speech signal and providing the first coefficient as a first coefficient signal, a residue generating unit for deriving a predicted residue from the speech signal by using the first coefficient signal, a second coefficient analyzing unit for deriving second coefficients representing a spectral characteristic of the predicted residue signal from the predicted residue signal and providing the second coefficients from the second coefficient signal, a coefficient quantizing unit for quantizing the second coefficients represented by the second coefficient signal and providing the quantized coefficient as a quantized coefficient signal, an excitation signal generating unit for deriving an excitation signal concerning the speech signal in the pertinent frame by using the speech signal, the first coefficient signal, the second coefficient signal and the quantized coefficient signal, quantizing the excitation signal, and providing the quantized signal as a quantized excitation signal, and a speech reproducing unit for reproducing a speech of the pertinent frame by using the first coefficient signal, the quantized coefficient signal and the quantized excitation signal and providing a speech reproduction signal.

According to another aspect of the present invention, there is provided a speech coder comprising a divider for dividing input speech signal into a plurality of frames having a redetermined time length, a first coefficient analyzing unit for deriving first coefficients representing a spectral characteristic of past reproduced speech signal from the reproduced speech signal and providing the first coefficients as a first coefficient signal, a residue generating unit for deriving a predicted residue from the speech signal by using the first coefficients and providing a predicted gain signal representing the predicted gain calculated from the predicted residue, a judging unit for judging whether the predicted gain represented by the predicted gain signal is above a predetermined threshold and providing a judge signal representing the result of the judge, a second coefficient analyzing unit operative, when the judge signal represented a predetermined value, to derive second coefficients representing a spectral characteristic of the predicted signal from the predicted gain signal and provide the second coefficients as a second coefficient signal, a coefficient quantizing unit for quantizing the second coefficients represented by the second coefficient signal, a coefficient quantizing unit for quantizing the second coefficients represented by the second coefficient signal and providing the quantized second coefficients as a quantized coefficient signal, an excitation generating unit for judging whether or not to use the second coefficients according to the judge signal, quantizing an excitation signal concerning the speech signal by using the speech signal, the second coefficient signal and the quantized coefficient signal and providing the quantized excitation signal, and a speech reproducing unit for judging whether to use the first coefficient according to the judge signal, making speech reproduction of the pertinent frame by using the second coefficient, the quantized coefficient signal and the quantized excitation signal and providing a speech reproduction signal.

According to other aspect of the present invention, there is provided a speech coder comprising a divider for dividing input speech signal into a plurality of frames having a redetermined time length, a mode judging unit for selecting one of a plurality of different modes by extracting a feature quantity from the speech signal and providing a mode signal representing the selected mode, a first coefficient analyzing unit operative, in case of a predetermined mode represented by the mode signal, to derive first coefficients representing a spectral characteristic of past reproduced speech signal from the reproduced speech signal and providing the first coefficients as a first coefficient signal, a residue generating unit for deriving a predicted residue or each frame from the speech signal by using the first coefficient signal and providing the predicted residue as a predicted residue signal, a second coefficient analyzing unit for deriving second coefficients representing a spectral characteristic of the predicted residue signal and providing the second coefficients as a second coefficient signal, a coefficient quantizing unit or quantizing the second coefficients represented by the second coefficient signal and providing the quantized second coefficients as a quantized coefficient signal, an excitation generating unit for deriving an excitation signal concerning the speech signal by using the speech signal, the first coefficient signal and the quantized coefficient signal, and a speech reproducing unit for making speech reproduction by using the first coefficient signal, the quantized coefficient signal and the quantized excitation signal and proving the speech reproduction signal.

According to other aspect of the present invention, there is provided a speech coding method comprising steps of dividing an input speech signal into a plurality of frames having a predetermined time length; deriving first coefficients representing a spectral characteristic of past reproduced signal from the reproduced speech signal and providing the first coefficient as a first coefficient signal; deriving a predicted residue from the speech signal by using the first coefficient signal; deriving second coefficients representing a spectral characteristic of the predicted residue signal from the predicted residue signal and providing the second coefficients from the second coefficient signal; quantizing the second coefficients represented by the second coefficient signal and providing the quantized coefficient as a quantized coefficient signal; deriving an excitation signal concerning the speech signal in the pertinent frame by using the speech signal, the first coefficient signal, the second coefficient signal and the quantized coefficient signal, quantizing the excitation signal, and providing the quantized signal as a quantized excitation signal; and reproducing a speech of the pertinent frame by using the first coefficient signal, the quantized coefficient signal and the quantized excitation signal and providing a speech reproduction signal.

According to still other aspect of the present invention, there is provided a speech coding method comprising steps of: dividing input speech signal into a plurality of frames having a redetermined time length; deriving first coefficients representing a spectral characteristic of past reproduced speech signal from the reproduced speech signal and providing the first coefficients as a first coefficient signal; deriving a predicted residue from the speech signal by using the first coefficients and providing a predicted gain signal representing the predicted gain calculated from the predicted residue; judging whether the predicted gain represented by the predicted gain signal is above a predetermined threshold and providing a judge signal representing the result of the judge, a second coefficient analyzing unit operative, when the judge signal represented a predetermined value, to derive second coefficients representing a spectral characteristic of the predicted signal from the predicted gain signal and provide the second coefficients as a second coefficient signal; quantizing the second coefficients represented by the second coefficient signal, quantizing the second coefficients represented by the second coefficient signal and providing the quantized second coefficients as a quantized coefficient signal; judging whether or not to use the second coefficients according to the judge signal, quantizing an excitation signal concerning the speech signal by using the speech signal, the second coefficient signal and the quantized coefficient signal and providing the quantized excitation signal; and judging whether to use the first coefficient according to the judge signal, making speech reproduction of the pertinent frame by using the second coefficient, the quantized coefficient signal and the quantized excitation signal and providing a speech reproduction signal.

According to further aspect of the present invention, there is provided a speech coding method comprising steps of dividing input speech signal into a plurality of frames having a redetermined time length, a mode judging unit for selecting one of a plurality of different modes by extracting a feature quantity from the speech signal and providing a mode signal representing the selected mode; deriving first coefficients representing a spectral characteristic of past reproduced speech signal from the reproduced speech signal and providing the first coefficients as a first coefficient signal, a residue generating unit for deriving a predicted residue or each frame from the speech signal by using the first coefficient signal and providing the predicted residue as a predicted residue signal, operative, in case of a predetermined mode represented by the mode signal; deriving second coefficients representing a spectral characteristic of the predicted residue signal and providing the second coefficients as a second coefficient signal; quantizing the second coefficients represented by the second coefficient signal and providing the quantized second coefficients as a quantized coefficient signal; deriving an excitation signal concerning the speech signal by using the speech signal, the first coefficient signal and the quantized coefficient signal; making speech reproduction by using the first coefficient signal, the quantized coefficient signal and the quantized excitation signal and proving the speech reproduction signal.

Other objects and features will be clarified from the following description with reference to attached drawings.

PREFERRED EMBODIMENTS OF THE INVENTION

Preferred embodiments of the present invention will now be described with reference to the drawings.

Figure 1:
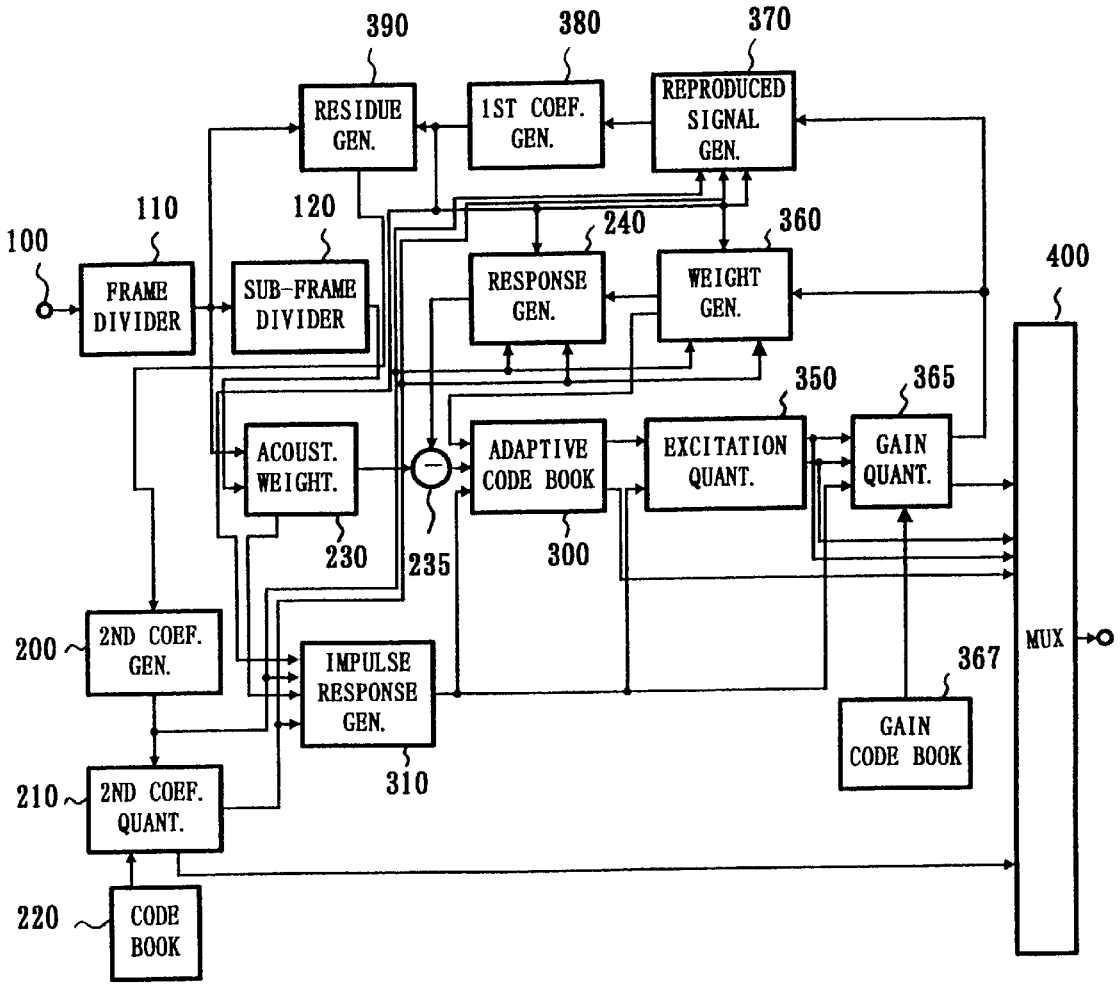
FIG. 1 is a block diagram showing the basic construction of a speech coder in accordance with a first embodiment of the present invention.

FIG. 1 is a block diagram showing the basic construction of a speech coder in accordance with a first embodiment of the present invention.

In this embodiment, a speech signal x(n) is provided from an input terminal 100 to a frame divider 110. The frame divider 110 divides the speech signal x(n) into frames (of 10 ms, for instance). A sub-frame divider 120 divides each frame speech signal into sub-frames (of 5 ms, for instance) each shorter than the frames.

A first coefficient signal generator (or first coefficient analyzer) 380 calculates first coefficients, which are given as linear prediction coefficients $\alpha_{1i}$ (i=1, . . . , P1) of predetermined P1 (for instance P1=20) degree through linear prediction analysis using a predetermined number of samples of a past frame reproduced speech signal s(n–L), and provides the calculated first coefficient as a first coefficient signal. The linear prediction analysis may be performed using any of the well-known process, such as LPC analysis or Burg analysis. Here, it is assumed that the Burg analysis is used. The Burg analysis is detailed in, for instance, Nakamizo, "Signal Analysis and System Identification", issued by Corona Co., Ltd., 1988, pp. 82–87 (hereinafter referred to as "Literature 4").

A residue signal generator (or residue calculator) 390 calculates a predictive residue signal e(n) given by equation (1). The predictive residue signal, e(n), results from calculation of inverse filtering of a predetermined number of samples of the speech signal x(n).

$$e(n) = x(n) - \sum_{i=1}^{P1} \alpha_{1i} x(n-i) \tag{1}$$

A second coefficient generator (or second coefficient analyzer) 200 calculates second coefficients $\alpha_{2j}$ (j=1, . . . , P2) of degree P2. The second coefficients are determined using linear predictive analysis on a predetermined number of samples of the predictive residue signal e(n). The second coefficient generator 200 converts the second coefficients $\alpha_{2j}$ into LSP parameters which are suited for quantization and interpolation, and provides these LSP parameters as a second coefficient signal. The conversion of the linear predictive coefficients into LSP parameters, may be performed by adopting techniques disclosed in Sugamura et al, "Speech Data Compression On The Basis Of Linear Spectrum Pair (LSP) Speech Analysis Synthesis System", The Transactions of Institute of Electronics and Communication Engineers of Japan, J64-A, pp. 599–606, 1981 (hereinafter referred to as "Literature 5").

A second coefficient quantizer (or coefficient quantizer) 210 efficiently: (i) quantizes the LSP parameters, represented by the second coefficient signal; (ii) using a codebook 220, selects codevector Dj which minimizes distortion given by equation (2); (iii) and provides an index of the selected codevector Dj as a quantized coefficient signal representing the quantized coefficients to a multiplexer 400.

$$D_j = \sum_{i=1}^{P2} W(i)[LSP(i) - QLSP(i)_j]^2 \tag{2}$$

where LSP(i), $QLSP(i)_j$ and W(i) are i-th LSP, j-th codevector stored in the codebook 220 and weighting coefficient, respectively, before the quantization.

In the following description, it is assumed that the vector quantization is employed, and that the LSP parameter representing the second coefficients are quantized. The LSP parameters may be quantized by vector quantization using a well-known method. Specific methods that can be utilized are disclosed in Japanese Laid-Open Patent Publication No. 4-171500 (Japanese Patent Application No. 2-297600, hereinafter referred to as "Literature 6"), Japanese Laid-Open Patent Publication No. 4-363000 (Japanese Patent Application No. 3-261925, hereinafter referred to as Literature 8), and T. Nomura et al, "LSP Coding Using VQ-SVQ with Interpolation in 4,075 kbps M-LCELP Speech Coder", Proc. Mobile Multimedia Communications, pp. B. 2.5, 1993 (hereinafter referred to as "Literature 9").

The second coefficient quantizer 210 also provides a quantized coefficient signal, representing linear prediction coefficients $\alpha'_{2j}$ (j=1, . . . , P2) obtained from the quantized LSP parameter, to an impulse response generator 310.

An acoustical weighting circuit 230 calculates linear prediction coefficients $\beta_i$ of predetermined degree P using Brug analysis from the speech signal x(n) from the frame divider 110. Using these linear prediction coefficients, a filter having a transfer characteristic H(z) given by equation (3) is formed. The acoustical weighting of the speech signal x(n) from the sub-frame divider 120 is performed to provide resultant weighted speech signal $x_w(n)$.

$$H(z) = \frac{1 - \sum_{i=1}^{P} \beta_i \gamma_1^i z^{-i}}{1 - \sum_{i=1}^{P} \beta_i \gamma_2^i z^{-i}} \tag{3}$$

where $\gamma_1$ and $\gamma_2$ are acoustical weighting factor control constants and are selected to adequate values such that $0<\gamma 2<\gamma 1 \leqq 1.0$. The linear prediction coefficient $\beta_i$ is provided to the impulse response generator 310.

The impulse response generator 310 calculates the impulse response $h_w(z)$ of an acoustic weighting filter. The z transform of the acoustic weighing filter is given by the equation (4) for a predetermined number L of instants, and provides the calculated impulse response to an adaptive codebook circuit 300, an excitation quantizer 350 and a gain quantizer 365.

$$H_w(z) = \frac{1 - \sum_{i=1}^{P} \beta_i \gamma_1^i z^{-i}}{1 - \sum_{i=1}^{P} \beta_i \gamma_2^i z^{-i}} \frac{1}{1 - \sum_{i=1}^{P1} \alpha_{1i} z^{-i}} \frac{1}{1 - \sum_{i=1}^{P2} \alpha \gamma'_{2i} z^{-i}} \tag{4}$$

A response signal generator 240 calculates response signal $x_z(n)$ of one sub-frame for the input signal of d(n)=0, from coefficients provided from the first and second coefficient generators 380 and 200, second coefficient quantizer 210 and stored filter memory values. The response signal generator 240 provides the calculated response signal $x_z(n)$ to a subtracter 235. The response signal $x_z(n)$ is given by equation (5).

$$x_z(n) = d(n) - \sum_{i=1}^{P} \beta_i \gamma_1^i d(n-i) + \sum_{i=1}^{P} \beta_i \gamma_2^i y_1(n-i) + \sum_{i=1}^{P1} \alpha_{1i} y_2(n-i) + \sum_{i=1}^{P2} \alpha'_{2i} x_z(n-i) \tag{5}$$

The subtracter 235 subtracts the response signal $x_z(n)$ from the weighted speech signal $x_w(n)$ for one frame, and provides the result $x'_w(n)$, given as $x'_w(n)=x_w(n)-x_z(n)$, to the adaptive codebook circuit 300.

The adaptive codebook circuit 300 is provided with past excitation signal v(n) from a weighting signal generator 360 which is described later, the output signal $x'_w(n)$ from the subtracter 235, and acoustic-weighted impulse signal $h_w(n)$ from the impulse response generator 310. The adaptive codebook circuit 300 calculates delay T corresponding to the pitch cycle according to a codevector which minimizes the distortion $D_T$ given by equation (6), and outputs an index representing the delay T to the multiplexer 400.

$$D_T = \sum_{n=0}^{N-1} x_w'^2(n) - \left[\sum_{n=0}^{N-1} x'_w(n) y_w(n-T)\right]^2 \Big/ \sum_{n=0}^{N-1} y_w^2(n-T) \Bigg] \tag{6}$$

where $y_w(n-T)=v(n-T)*h_w(n)$ represents a pitch prediction signal, and symbol * represents a convolution operation.

Gain η is calculated in accordance with equation (7).

$$\eta = \sum_{n=0}^{N-1} x'_w(n) y_w(n-T) \Big/ \sum_{n=0}^{N-1} y_w^2(n-T) \tag{7}$$

To improve the extraction accuracy of the delay T for a woman's voice and a child's voice, the delay T may be derived not from an integral number of samples, but from a decimal number of samples. A specific method to this end may be adopted by referring to, for instance, P. Kroon et al., "Pitch Predictors With High Temporal Resolution", Proc. ICASSP, pp. 661–664, 1990 (hereinafter referred to as "Literature 10").

The adaptive codebook circuit 300 further provides pitch prediction residue signal $z_w(n)$ given as $z_w(n)=x'_w(n)-\eta v(n-T)*h_w(n)$, obtained by pitch prediction using selected delay T and gain η. The adaptive codebook circuit 300 also provides a pitch prediction signal obtained by using the selected delay T. The pitch prediction residue signal $Z_w(n)$ and the pitch prediction signal are coupled to the excitation quantizer (or excitation calculator) 350.

The excitation quantizer 350 assigns M non-zero amplitude pulses to each sub-frame, and sets a pulse position retrieval range of each pulse. For example, assuming the case of determining the positions of five pulses in a 5-ms sub-frame (i.e., 40 samples), the candidate pulse positions in the pulse position retrieval range of the first pulse are 0, 5, . . . , 35, those of the second pulse are 1, 6, . . . , 36, those of the third pulse are 2, 7, . . . , 37, those of the fourth pulse are 3, 8, . . . , 38, and those of the fifth pulse are 4, 9, . . . , 39.

Figure 2:
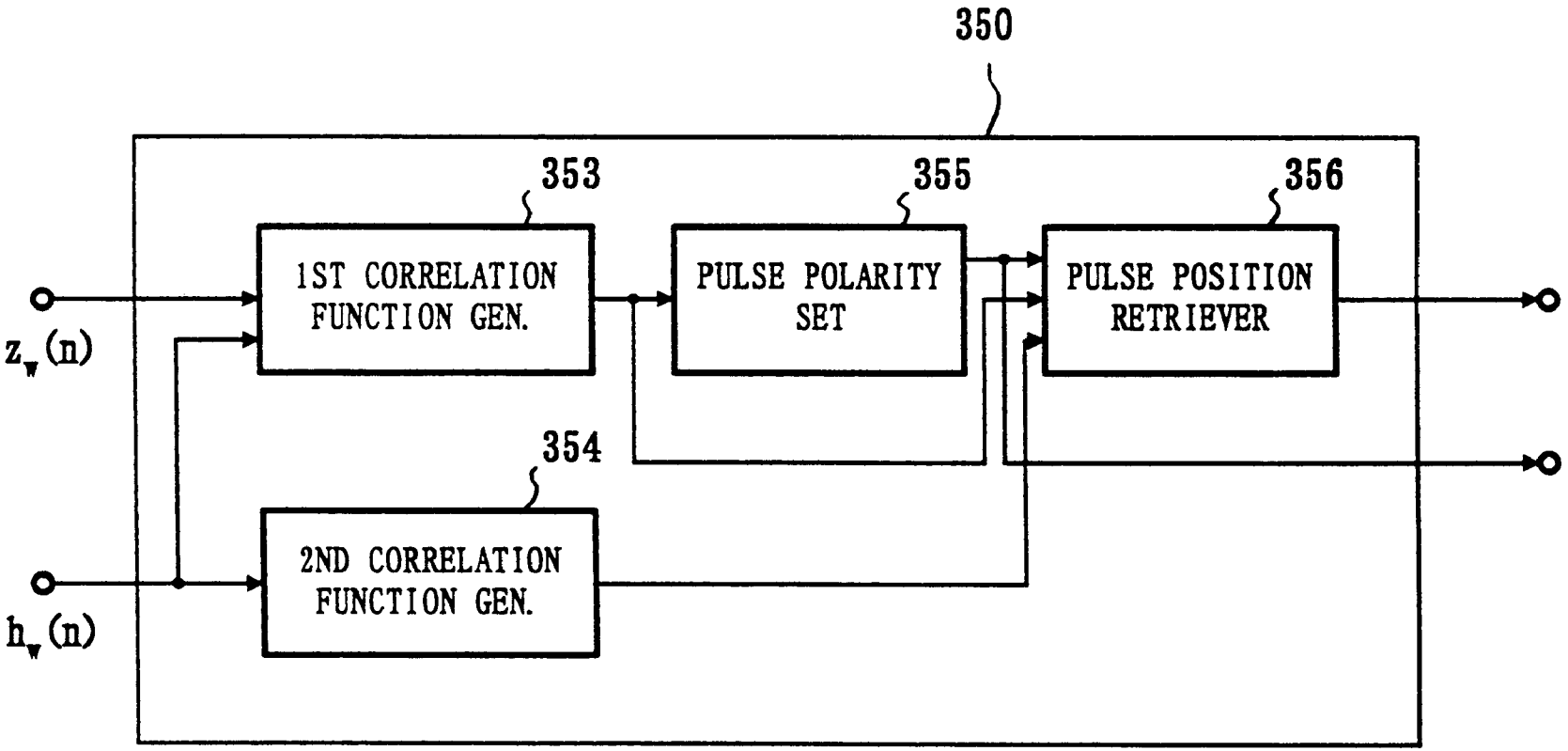
FIG. 2 is a detailed construction of the excitation quantizer of FIG. 1.

FIG. 2 shows the detailed construction of the excitation quantizer 350. A first correlation function generator 353 receives $z_w(n)$ and $h_w(n)$, and calculates a first correlation function ψ(n) given by equation (8). A second correlation function generator 354 receives $h_w(n)$, and calculates a second correlation function φ(p, q) given by equation (9).

$$\phi(n) = \sum_{i=n}^{N-1} z_w(i) h_w(i-n),\ n = 0, \cdots, N-1 \tag{8}$$

$$\phi(p, q) = \sum_{n=\max(p,q)}^{N-1} h_w(n-p) h_w(n-q),\ p, q = 0, \cdots, N-1 \tag{9}$$

A pulse polarity setting circuit 355 extracts and provides polarity data of the first correlation function ψ(n) for each candidate pulse position. A pulse position retrieving circuit 356 calculates function D given as $D=C_k^2/E_K$ for each of the candidate pulse position combinations noted above, and selects a position which maximizes the function as an optimum position.

Denoting the number of pulses per sub-frame by M, the values for $C_k$ and E are expressed by the following equations (10) and (11), respectively.

$$C_k = \sum_{k=1}^{M} \mathrm{sign}(k)\phi(m_k) \tag{10}$$

$$E = \sum_{k=1}^{M} \mathrm{sign}(k)^2 \phi(m_k, m_k) + 2\sum_{k=1}^{M-1} \sum_{i=k+1}^{M1} \mathrm{sign}(k)\mathrm{sign}(i)\phi(m_k, m_i) \tag{11}$$

where sign(k) represents the polarity of the k-th pulse and the polarity extracted in the pulse polarity setting circuit 355. In this way, the excitation quantizer 350 provides data of the polarities and positions of M pulses to the gain quantizer 365. The excitation quantizer 350 provides a pulse position index, obtained by quantizing each pulse position with a predetermined number of bits, and also pulse polarity data to the multiplexer 400.

The gain quantizer 365 reads out gain codevectors from a gain codebook 367 and selects a gain codevector which maximizes the value of equation (12). The gain quantizer also selects a combination of an amplitude codevector and a gain codevector which minimizes the value of distortion $D_t$.

$$D_t = \sum_{n=0}^{N-1} \left[x'_w(n) - \eta'_t v(n-T) * h_w(n) - G'_t \sum_{k=1}^{M} \mathrm{sign}(k) h_w(n-m_k)\right]^2 \tag{12}$$

Here, two kinds of gains such as gain η' of the adaptive codebook and gain G' of excitation expressed by pulses are simultaneously vector-quantized. Gains $\eta'_t$ and $G'_t$ constitute t-th element in two-dimensional gain codevectors stored in the gain codevector book 367. The gain quantizer 365 selects a gain codevector which minimizes the value of the distortion $D_t$ by repetitively executing the above calculation for each gain codevector, and provides an index representing the selected gain codevector to the multiplexer 400.

The reproduced speech signal generator (or speech reproducing unit) 370 provides a reproduced speech signal using speech reproduction. The speech reproduction is performed by storing speech signal s(n) (n=0, . . . , N−1, N being the number of samples in a frame) for one frame. Filter transfer characteristic H'(z) in this operation is as shown in equation (13).

$$H'(z) = \frac{1}{1 - \sum_{i=1}^{P1} \alpha_{1i} z^{-i}} \frac{1}{1 - \sum_{i=1}^{P2} \alpha'_{2i} z^{-i}} \tag{13}$$

A filter using the first coefficient $\alpha_{1i}$ and a filter using the quantized second coefficient $\alpha'_{2i}$ both have recursive structures.

The weighting signal generator 360 receives the individual indexes, reads out corresponding codevectors, and calculates drive excitation signal v(n) given by equation (14).

$$v(n) = \eta'_t v(n-T) + G'_t \sum_{k=1}^{M} \text{sign}(k)\delta(n - m_k) \tag{14}$$

The drive excitation signal v(n) is provided to the above adaptive codebook circuit 300. The weighting signal calculator 360 then generates a response signal $s_w(n)$, given by equation (15) for one sub-frame. The response signal $s_w(n)$ is determined using a response calculation which receives output parameters from the first coefficient generator 380, the second coefficient generator 200 and the second coefficient quantizer 210. The response signal $s_w(n)$ is coupled to the response signal generator 240.

$$s_w(n) = v(n) - \sum_{i=1}^{P} \beta_i \gamma_1^i v(n-i) + \sum_{i=1}^{P} \beta_i \gamma_2^i P_1(n-i) + \sum_{i=1}^{P1} \alpha_{1i} p_2(n-i) + \sum_{i=1}^{P2} \alpha'_{2i} s_w(n-i) \tag{15}$$

In the first embodiment of the speech coder, the individual components operate as described above. The reproduced speech signal generator 370, weighting signal generator 360 and response signal generator 240 all use recursive filters for filtering the first coefficient signal.

Figure 3:
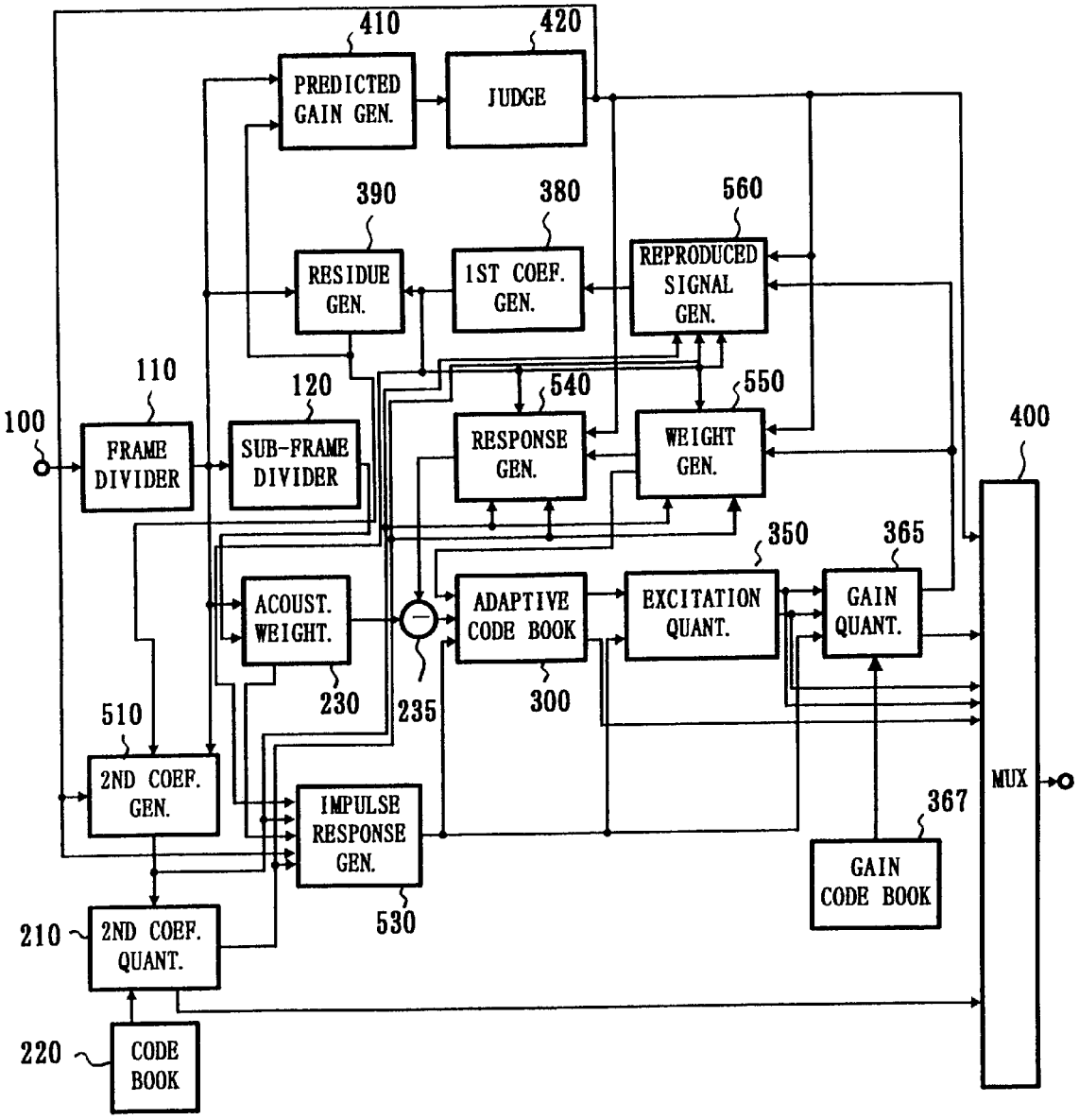
FIG. 3 is a block diagram showing the basic construction of a speech coder according to a second embodiment of the present invention.

In this speech coder, the first coefficients representing a spectral characteristic of the past reproduced speech signal is first developed. Next, the predicted residue signal is developed by prediction of the pertinent frame speech signal from the first coefficients. The second coefficients representing a spectral characteristic of the predicted residue signal is then developed. Next, the second coefficients are quantized to develop the quantized coefficient signal. The excitation signal is then obtained from the first coefficient signal, quantized coefficient signal and speech signal. Thus, while the sole second coefficient signal is transmitted, the prediction is performed in the sum of the degrees of the first and second coefficients. It is thus possible to greatly improve the approximation accuracy speech signal spectrum. In addition, in the event that an eror is generated on the transmission line, the sound quality will not deteriorate as much as the prior art systems because the second coefficients are more immune to errors. With this speech coder, it is thus possible to obtain, with the same bit rate as in the prior art, compressed decoded speech of higher quality with a relatively lower calculation effort. FIG. 3 is a block diagram showing the basic construction of a speech coder according to a second embodiment of the present invention.

Compared to the preceding first embodiment of the speech coder, this embodiment further comprises a predicted gain generator 410 and a judging circuit 420. In addition, the functions of some parts of this second embodiment are different than in the first embodiment and, therefore, these parts are designated by different reference numerals.

In this speech coder, the predicted gain generator 410 calculates predicted gain $G_p$, given by equation (16), from the speech signal. The predicted gain generator 410 also calculates the predicted residue signal from the residue signal generator 390. A predicted gain signal representing the calculation result of the predicted gain $G_p$ is coupled to the judging circuit 420.

$$G_p = \frac{\sum_{i=0}^{N-1} x^2(n)}{\sum_{i=0}^{N-1} e^2(n)} \tag{16}$$

The residual signal generator 390 and predicted gain generator 410 constitute a residue generator, which derives the predicted residue from the speech signal by using the first coefficient signal and provides the predicted gain signal representing the calculation result of the predicted gain corresponding to the derived predicted residue.

The judging circuit 420 compares the predicted gain $G_p$ with a predetermined threshold and judges whether the predicted gain $G_p$ is greater than the threshold. The judging circuit 420 provides a judge signal representing judge data, which is "1" when $G_p$ is less than the threshold and "0" when $G_p$ is greater than the threshold, to a second coefficient generator 510, an impulse response generator 530, a response generator 540, a weighting signal generator 550, a reproduced speech signal generator 560, and the multiplexer 400.

The second coefficient generator 510 receives the judge signal, and when the judge data thereof is "1", it calculates the second coefficient from the predicted residue signal, and provides the calculation result as a second coefficient signal. When the judge data is "0", the second coefficient generator 510 generates a speech signal from the frame divider 110, calculates the second signal therefrom, and provides the result as the second coefficient signal.

As for the impulse generator 530, response signal generator 540, weighting signal generator 550 and reproduced speech signal generator 560, a decision as to whether the first coefficients are to be used is performed according to the judge data. When the judge data is "1", the first coefficient signal from the first coefficient signal generator 380, the second coefficient signal from the second coefficient signal generator 510, and the quantization coefficient signal from the second coefficient quantizing circuit 210 are used. When the judge data is "0", the first coefficient signal from the first coefficient generator 380 is not used.

The parts other than those described above have the same functions as in the first embodiment. In the second embodiment of the speech coder, the individual parts have the functions as described above. The reproduced signal generator 560, weighting signal generator 550 and response signal generator 540 each use a recursive filter for filtering the first coefficient signal.

In this speech coder, the predicted gain based on the first coefficient is calculated, and the first coefficients are used in combination with the second coefficient when and only when the predicted gain is above the threshold. Thus, it is possible to prevent deterioration of the overall sound quality even in a section in which the prediction based on the first coefficient is deteriorated. In addition, even when an error occurs on the transmission line, the occurrence frequency of reproduced speech difference between the transmitting and receiving sides is reduced, so that it is possible to obtain high quality speech as a whole compared to the quality obtainable in the prior art.

Figure 4:
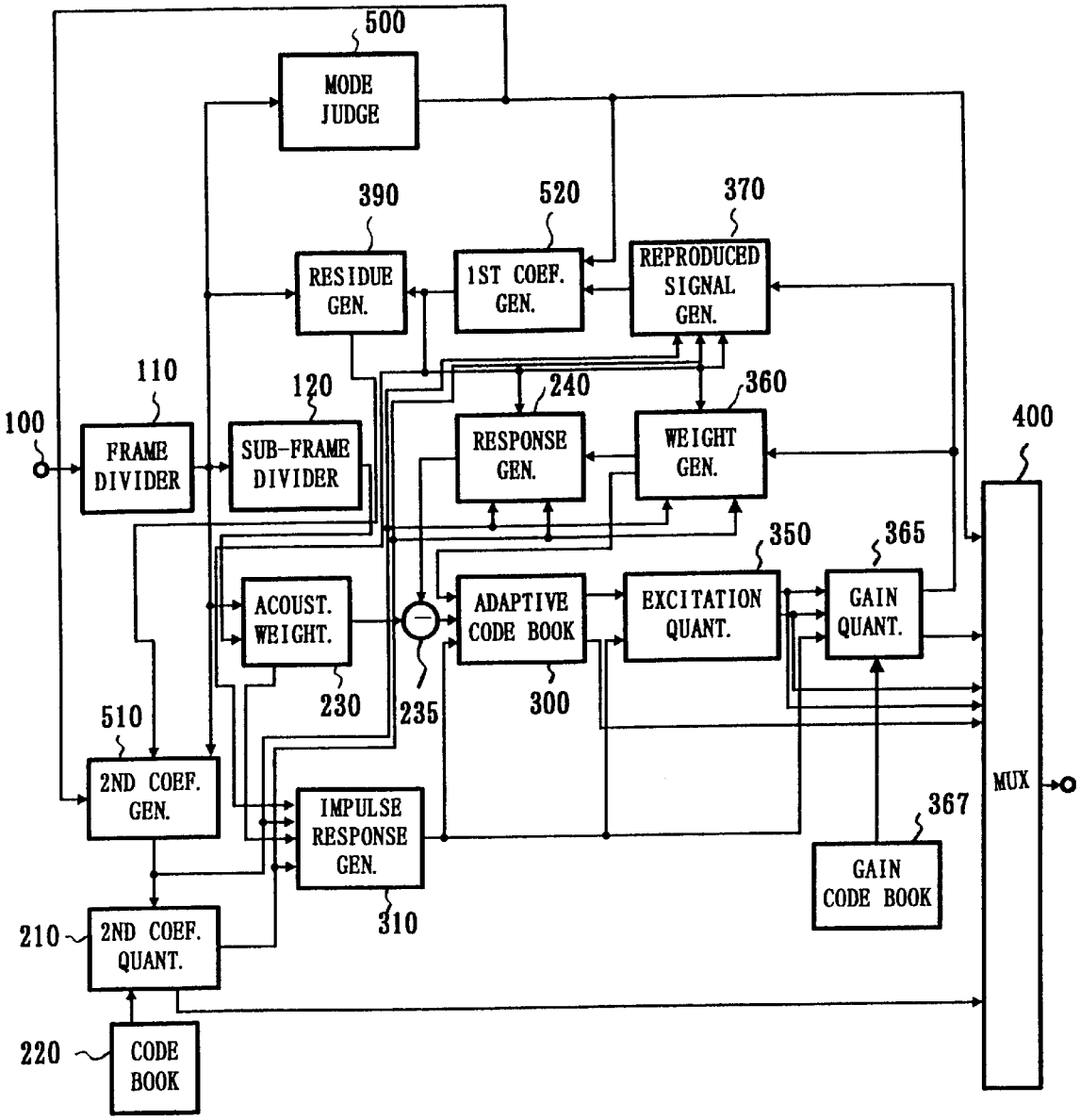
FIG. 4 is a block diagram showing the basic construction of a speech coder according to a third embodiment to the present invention.

FIG. 4 is a block diagram showing the basic construction of a speech coder according to a third embodiment of the present invention.

Compared to speech coder of the previous first embodiment of the invention, this speech coder further comprises a mode judging circuit 500. The functions of some parts of this embodiment are different from the first embodiment and, therefore, are designated by different reference numerals. Like parts between this embodiment and the first embodiment are designated by like reference numerals and are not described again.

In this speech coder, the mode judging circuit 500 receives the speech signal frame by frame from the frame divider 110, extracts a feature quantity from the received speech signal, and provides a mode selection signal containing mode judge data representing a selected one of a plurality of modes to a first coefficient generator 520, a second coefficient generator 510 and the multiplexer 400.

The mode judging circuit 500 uses a feature quantity of the present frame for the mode judge. The feature quantity may be the frame mean pitch predicted gain. The pitch predicted gain is calculated according to the following equation (17).

$$G = 10\log_{10}\left[1/L\sum_{i=1}^{L}(P_i/E_i)\right] \tag{17}$$

where L is the number of sub-frames contained in the frame, and $P_i$ and $E_i$ are the speech power and the pitch predicted error power of i-th frame as given by equations (18) and (19).

$$P_i = \sum_{n=0}^{N-1} x_i^2(n) \tag{18}$$

$$E_i = P_i - \left[\sum_{n=0}^{N-1} x_i(n)x_i(n-T)\right]^2 \Big/ \left[\sum_{n=0}^{N-1} x_i^2(n-T)\right] \tag{19}$$

where $x_i(n)$ is the speech signal in the i-th sub-frame, and T the optimum delay corresponding to the maximum predicted gain. The mode judging circuit 500 classifies the modes into a plurality of different kinds (for instance R kinds) by comparing the frame mean pitch predicted gain with a plurality of predetermined thresholds. The number R of different mode kinds may be 4. The modes may correspond to a no-sound section, a transient section, a weak vowel steady-state section, a strong vowel steady-state section, etc.

The first coefficient generator 520 receives the mode selection signal, and when and only when the mode discrimination data thereof represents a predetermined mode, calculates the first coefficient from the past reproduced speech signal. Otherwise, the first coefficient generator 520 does not calculate the first coefficients.

The second coefficient calculator 510 receives the mode selection signal, and when and only when mode discrimination data thereof represents a predetermined mode, it calculates the second coefficient from the predicted error signal from the predicted residue signal generator 390. Otherwise, the second coefficient calculator 510 calculates the second coefficient from the speech signal from the frame divider 110.

The other parts as those described above have the same functions as in the first embodiment. In the speech coder in the third embodiment, the individual parts have the same functions as described above.

In this speech coder, one of a plurality of modes is discriminated by extracting a feature quantity from the speech signal. In a predetermined mode (for instance, one in which the speech signal characteristics are less subject to changes with time, such as a steady-state section of a vowel), the second coefficients are calculated from the predicted residue signal after deriving the first coefficients, and the first and second coefficients are used in combination. Thus, it is possible, without the need for a predicted gain judge, to prevent the deterioration of the prediction based on the first coefficient, and improve the sound quality as compared to the prior art. In addition, even when an error occurs in the transmission line, the occurrence frequency of the reproduced speech difference between the transmitting and receiving sides is reduced. Thus, it is possible to obtain high quality speech as a whole compared to the quality obtainable in the prior art.

Figure 5:
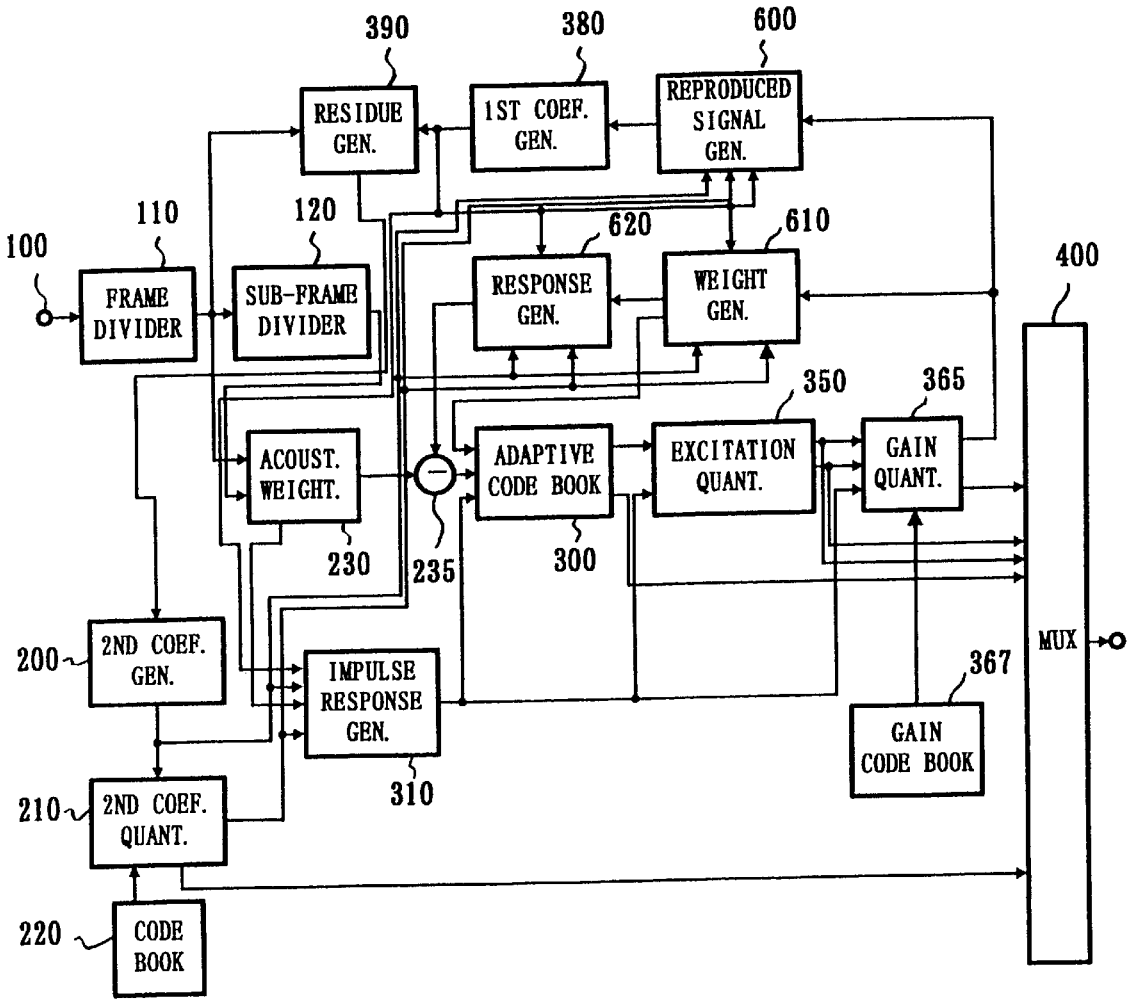
FIGS. 5 to 7 show modifications of the embodiments of the speech coder shown in FIGS. 1, 3 and 4, respectively.
Figure 6:
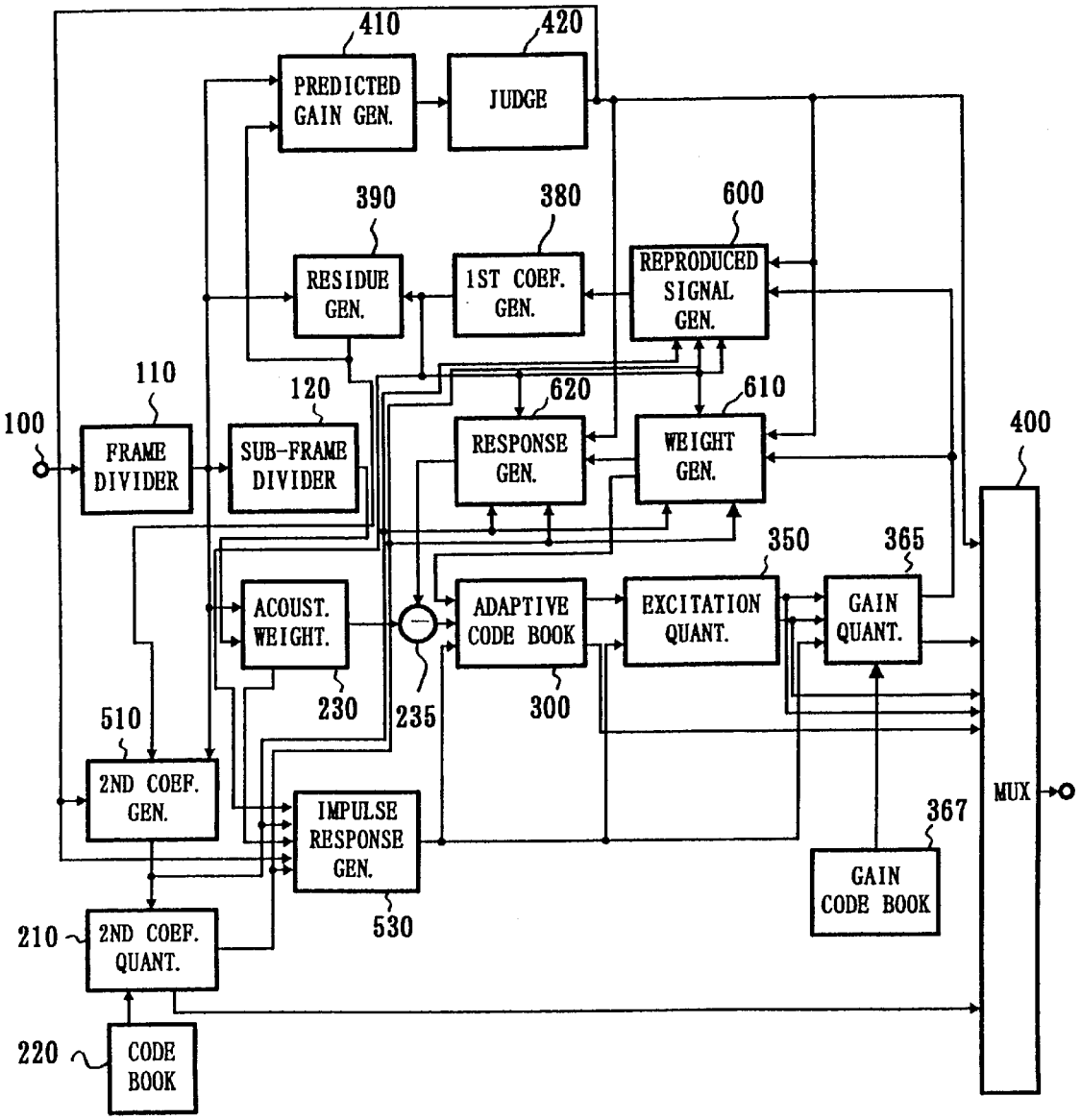
Figure 7:
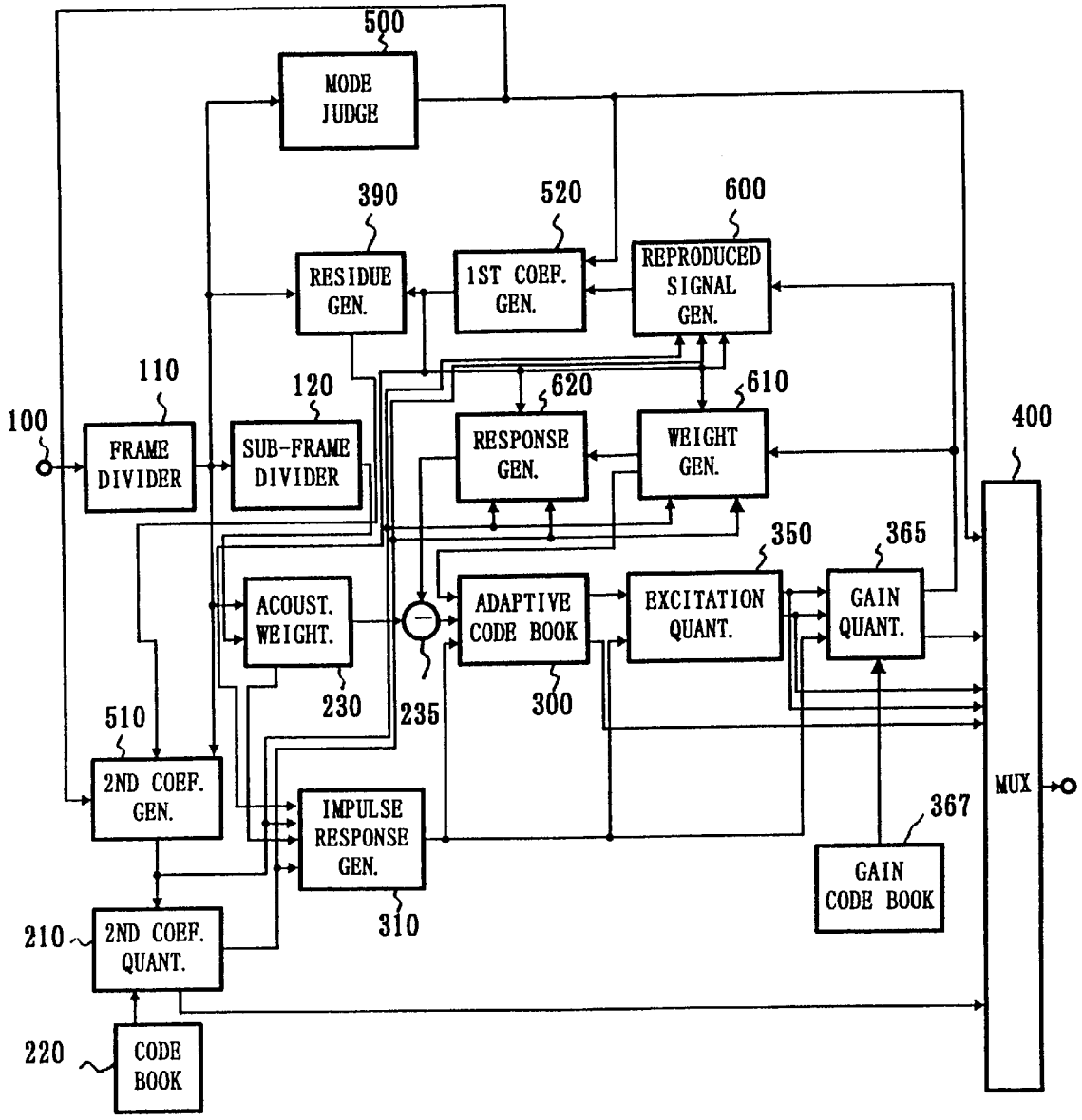

The above embodiments of the speech coder may be modified and still be within the scope of the invention. FIGS. 5 and 7 show modifications of the embodiments of the speech coder shown in FIGS. 1 and 4, respectively. In these modifications, non-recursive filters are used instead of the recursive filters, which filters are used for filtering the first coefficient signal in the reproduced signal generator 370, weighting signal generator 360, and response signal generator 240. FIG. 6 is a modification of the embodiment shown in FIG. 3. In this modification, non-recursive filters are used in lieu of the recursive filters, which filters are used for filtering the first coefficient signal in the reproduced signal generator 560, weighting signal generator 350 and response signal generator 540. In either case, the reproduced speech signal generator 600, weighting signal generator 610 and response signal generator 620 are provided.

As an example, the transfer characteristic Q(z) of the non-recursive filter in the reproduced signal generator 600 shown in FIG. 5 is given by the following equation (20).

$$Q(z) = \frac{1 - \sum_{i=1}^{P1} \alpha_{1i} z^{-i}}{1 - \sum_{i=1}^{P2} \alpha'_{2i} z^{-i}} \tag{20}$$

Here, the filter using the first coefficients $\alpha_{1i}$ is of the recursive-type. The weighting signal generator 610 and the response signal generator 620 likewise use the first coefficients $\alpha_{1i}$ and, thus, use non-recursive filters of the same construction.

With this speech coder, in which the signal reproduction section uses a non-recursive filter on the first coefficient, it is possible to increase the robustness of the system with respect errors on the transmission line.

In the excitation quantizer 350 in the above embodiments of the speech coder, the pulse amplitude was expressed in terms of instantaneous polarities. It is also possible, however, to collectively store amplitudes of a plurality of pulses in an amplitude codebook and permit selection of an optimum amplitude codevector from this codebook. As a further alternative, it is possible to use, in place of the amplitude codebook, a polarity codebook, in which pulse polarity combinations are prepared in a number corresponding to the number of the pulses.

As has been described in the foregoing, in the speech quantizer according to the present invention, first coefficients representing a spectral characteristic of past reproduced speech signal are derived. Next, a predicted residue signal is obtained by predicting the speech signal in the pertinent frame with the derived first coefficients. Second coefficients representing a spectral characteristic of the predicted residue signal are then obtained, a quantized coefficient signal is obtained by quantizing the second coefficients. Next, an excitation signal is provided from the first coefficient signal, quantized coefficient signal and speech signal. Thus, it is possible to permit prediction in the sum of the degrees of the first and second coefficients, while sending out the sole second coefficient signal. Also, with an arrangement that the predicted gain is calculated from the first coefficient and that the second coefficients are used in combination with the first coefficients when and only when the predicted gain exceeds a predetermined predicted gain, changes in speech signal characteristics with time may be increased to prevent deterioration of the overall sound quality, even in a section in which the prediction based on the first coefficients is deteriorated. Thus, when an error occurs on the transmission line, the occurrence frequency of reproduced speech difference between the transmitting and receiving sides is reduced. Furthermore, with an arrangement that one of a plurality of modes is discriminated by extracting a feature quantity of speech signal and that the second coefficients are calculated from the predicted residue signal in a predetermined mode after deriving the first coefficient, it is possible to use the first and second coefficients in combination. Thus, without the need of the predicted gain judge, it is possible to prevent deterioration of the overall sound quality due the first coefficients, thereby reducing the occurrence frequency of reduced speech difference between the transmitting and receiving sides in the event of transmission line error generation. Moreover, by replacing the reflexive filters in the speech reproducing section with non-recursive filters, the robustness of the system with respect to transmission line errors can be improved, so that further sound quality improvement can be obtained with relatively less computational effort.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A speech coder comprising:

a divider operable to divide an input speech signal into a plurality of frames having a predetermined time length;

a first coefficient analyzing unit operable to derive first coefficients representing a spectral characteristic of a past speech reproduction signal and provide the first coefficients as a first coefficient signal;

a residue generating unit operable to derive a predicted residue signal from the input speech signal by using the first coefficient signal;

a second coefficient analyzing unit operable to derive second coefficients representing a spectral characteristic of the predicted residue signal and provide the second coefficients as a second coefficient signal;

a coefficient quantizing unit operable to quantize the second coefficients represented by the second coefficient signal and provide the quantized second coefficients as a quantized coefficient signal;

an excitation signal generating unit operable to derive an excitation signal in accordance with the input speech signal in a particular frame, the first coefficient signal, the second coefficient signal and the quantized coefficient signal, the excitation signal generating unit including a quantizer operable to quantize the excitation signal and provide the quantized signal as a quantized excitation signal; and a speech reproducing unit operable to reproduce speech of the particular frame by using the first coefficient signal, the quantized coefficient signal and the quantized excitation signal to produce a speech reproduction signal;

the past speech reproduction signal being derived from the speech reproduction signal.

2. The speech coder according to claim 1, wherein the speech reproducing unit uses a non-reflexive filter for filtering the first coefficient signal.

3. A speech coder comprising:

a divider operable to divide an input speech signal into a plurality of frames having a predetermined time length;

a first coefficient analyzing unit operable to derive first coefficients representing a spectral characteristic of a past speech reproduction signal and provide the first coefficients as a first coefficient signal;

a residue generating unit operable to derive a predicted residue from the input speech signal by using the first coefficients and provide a predicted gain signal representing a predicted gain calculated from the predicted residue;

a judging unit operable to determine whether the predicted gain represented by the predicted gain signal is above a predetermined threshold and provide a judge signal representing the result of the determination;

a second coefficient analyzing unit operative, when the judge signal represents a predetermined value, to derive second coefficients representing a spectral characteristic of the predicted gain from the predicted gain signal and provide the second coefficients as a second coefficient signal;

a coefficient quantizing unit operable to quantize the second coefficients represented by the second coefficient signal and provide the quantized second coefficients as a quantized coefficient signal;

an excitation generating unit operable to produce a quantized excitation signal in accordance with the input speech signal by quantizing the speech signal, the second coefficient signal and the quantized coefficient signal, the excitation generating unit using the second coefficients to produce the quantized excitation signal depending on the value of the judge signal; and a speech reproducing unit operable to produce a speech reproduction signal of a pertinent frame by using the second coefficients, the quantized coefficient signal and the quantized excitation signal, the speech reproducing unit using the first coefficients to produce the speech reproduction signal depending on the value of the judge signal;

the past speech reproduction signal being derived from the speech reproduction signal.

4. The speech coder according to claim 3, wherein the speech reproducing unit uses a non-reflexive filter for filtering the first coefficient signal.

5. A speech coder comprising:

a divider for dividing an input speech signal into a plurality of frames having a predetermined time length;

a mode judging unit for selecting one of a plurality of different modes by extracting a feature quantity from the input speech signal and providing a mode signal representing the selected mode;

a first coefficient analyzing unit operative, when a predetermined one of the modes exists as represented by the mode signal, to derive first coefficients representing a spectral characteristic of a past speech reproduction signal and providing the first coefficients as a first coefficient signal;

a residue generating unit for deriving a predicted residue signal for each frame of the input speech signal by using the first coefficient signal;

a second coefficient analyzing unit for deriving second coefficients representing a spectral characteristic of the predicted residue signal and providing the second coefficients as a second coefficient signal;

a coefficient quantizing unit or quantizing the second coefficients represented by the second coefficient signal and providing the quantized second coefficients as a quantized coefficient signal;

an excitation signal generating unit for deriving an excitation signal in accordance with the input speech signal, the first coefficient signal and the quantized coefficient signal; and a speech reproducing unit for producing a speech reproduction signal by using the first coefficient signal, the quantized coefficient signal and the quantized excitation signal;

the past speech reproduction signal being derived from the speech reproduction signal.

6. The speech coder according to claim 5, wherein the speech reproducing unit uses a non-reflexive filter for filtering the first coefficient signal.

7. A speech coding method comprising the steps of:

dividing an input speech signal into a plurality of frames having a predetermined time length;

deriving first coefficients representing a spectral characteristic of a past speech reproduction signal and providing the first coefficients as a first coefficient signal;

deriving a predicted residue signal from the input speech signal by using the first coefficient signal;

deriving second coefficients representing a spectral characteristic of the predicted residue signal and providing the second coefficients as a second coefficient signal;

quantizing the second coefficients represented by the second coefficient signal and providing the quantized coefficients as a quantized coefficient signal;

deriving an excitation signal in accordance with the input speech signal in a particular frame, the first coefficient signal, the second coefficient signal and the quantized coefficient signal, quantizing the excitation signal, and providing the quantized signal as a quantized excitation signal; and reproducing speech of the particular frame by using the first coefficient signal, the quantized coefficient signal and the quantized excitation signal to produce a speech reproduction signal, the past speech reproduction signal being derived from the speech reproduction signal.

8. A speech coding method comprising the steps of:

dividing an input speech signal into a plurality of frames having a predetermined time length;

deriving first coefficients representing a spectral characteristic of a past speech reproduction signal and providing the first coefficients as a first coefficient signal;

deriving a predicted residue from the input speech signal by using the first coefficients and providing a predicted gain signal representing a predicted gain calculated from the predicted residue;

determining whether the predicted gain represented by the predicted gain signal is above a predetermined threshold and providing a judge signal representing the result of the determination;

deriving second coefficients representing a spectral characteristic of the predicted gain from the predicted gain signal and providing the second coefficients as a second coefficient signal, the deriving and providing steps operative when the judge signal represents a predetermined value;

quantizing the second coefficients represented by the second coefficient signal and providing the quantized second coefficients as a quantized coefficient signal;

producing a quantized excitation signal according to the input speech signal by quantizing the speech signal, the second coefficient signal and the quantized coefficient signal, wherein the second coefficients are used to produce the quantized excitation signal depending on the value of the judge signal; and making a speech reproduction signal of the particular frame by using the second coefficients, the quantized coefficient signal and the quantized excitation signal, wherein the first coefficients are used to produce the speech reproduction signal depending on the value of the judge signal.

9. A speech coding method comprising the steps of:

dividing an input speech signal into a plurality of frames having a predetermined time length;

selecting one of a plurality of different modes by extracting a feature quantity from the input speech signal and providing a mode signal representing the selected mode;

deriving first coefficients representing a spectral characteristic of a past speech reproduction signal and providing the first coefficients as a first coefficient signal;

deriving a predicted residue signal for each frame of the input speech signal by using the first coefficient signal when a predetermined mode is represented by the mode signal;

deriving second coefficients representing a spectral characteristic of the predicted residue signal and providing the second coefficients as a second coefficient signal;

quantizing the second coefficients represented by the second coefficient signal and providing the quantized second coefficients as a quantized coefficient signal;

deriving an excitation signal in accordance with the input speech signal, the first coefficient signal and the quantized coefficient signal;

producing a speech reproduction signal by using the first coefficient signal, the quantized coefficient signal and the quantized excitation signal;

the past speech reproduction signal being derived from the speech reproduction signal.

10. A coder for producing an output speech signal from an input speech signal, comprising:

a frame divider adapted to divide the input speech signal into time frames of a predetermined length;

a first signal generator having a linear prediction analyzer to produce first linear prediction coefficients (FLPCs) from a predetermined number of samples of an output speech feedback signal, the FLPCs being of a predetermined degree;

a residue signal generator adapted to produce a predictive residue signal as a function of inverse filtering a predetermined number of samples of the input speech signal and the FLPCs;

a second signal generator having a linear prediction analyzer to produce second linear prediction coefficients (SLPCs) from a predetermined number of samples of the predictive residue signal, the SLPCs being of a predetermined degree, the second signal generator having a linear spectrum pair (LSP) analyzer to produce LSP parameters from the SLPCs;

a quantizer adapted to produce a quantized signal obtained by quantizing the LSP parameters;

an excitation unit having an excitation quantizer, the excitation unit being adapted to produce a quantized excitation signal based on the input speech signal, the FLPCs, the SLPCs, and the quantized signal; and a speech reproducing unit adapted to produce a speech reproduction signal for each frame and the output speech feedback signal using the FLPCs, the quantized signal and the quantized excitation signal.

11. The coder of claim 10, wherein the linear prediction analyzer employs linear prediction coding analysis to produce the FLPCs.

12. The coder of claim 10, wherein the linear prediction analyzer employs Burg analysis to produce the FLPCs.

13. The coder of claim 10, wherein the predictive residue signal substantially adheres to the following equation:

$$e(n) = x(n) - \sum_{i=1}^{P1} \alpha_{1i} x(n-i)$$

where e(n) is the predictive residue signal, x(n) is the input speech signal, $\alpha_{1i}$ are the FLPCs, and P1 is the predetermined degree of the FLPCs.

14. The coder of claim 10, wherein the quantizer comprises a codebook unit having a plurality of sets of data including: an i-th input LSP value (LSP(i)), a j-th quantized LSP value ($QLSP(i)_j$), an i-th weighing value (W(i)), and an i-th indexed codevector (D(j)) representing the quantized signal, wherein the quantized signal substantially adheres to the following equation:

$$D_j = \sum_{i=1}^{P2} W(i)[LSP(i) - (QLSP(i))_j]^2$$

where P2 is the degree of the codevector D(j).

15. The coder of claim 10, wherein the excitation unit comprises:

an acoustical weighing circuit having a linear prediction analyzer adapted to produce third linear prediction coefficients (TLPCs) from the input speech signal, the acoustical weighing circuit also having a filter adapted to receive the TLPCs to produce a weighted speech signal;

an impulse generator adapted to produce an impulse response from a z-transform circuit;

a response signal generator adapted to produce a response signal representing the input speech signal at zero value from the FLPCs, SLPCs, quantized signal and stored memory values;

a subtractor adapted to produce a subtraction signal by subtracting the response signal from the weighted speech signal;

an adaptive codebook unit adapted to determine a pitch prediction signal as a function of a delay T, the subtraction signal, the impulse response from the impulse generator, and a past sample of the excitation signal, the adaptive codebook unit also being adapted to produce a pitch prediction residue signal as a function of a gain value, the delay T, the subtraction signal, the impulse response from the impulse generator, and a past sample of the excitation signal; and an excitation quantizer adapted to produce a quantized excitation signal from the impulse response from the impulse generator, pitch prediction signal, and the pitch prediction signal.

16. The coder of claim 15, wherein the filter of the acoustical weighing circuit has a transfer function which substantially adheres to the following equation:

$$H(z) = \frac{1 - \sum_{i=1}^{P} \beta_i \gamma_1^i z^{-i}}{1 - \sum_{i=1}^{P} \beta_i \gamma_2^i z^{-i}}$$

where $\beta_i$ are the TLPCs having a predetermined degree P, and $\gamma_1$ and $\gamma_2$ are acoustical weighing factor control constants selected such that $0<\gamma_2<\gamma_1 \leqq 1.0$.

17. The coder of claim 15, wherein the z-transform of circuit which produces the calculated impulse response substantially adheres to the following equation:

$$H(z) = \frac{1 - \sum_{i=1}^{P} \beta_i \gamma_1^i z^{-i}}{1 - \sum_{i=1}^{P} \beta_i \gamma_2^i z^{-i}} \frac{1}{1 - \sum_{i=1}^{P1} \alpha_{1i} z^{-i}} \frac{1}{1 - \sum_{i=1}^{P2} \alpha'_{2i} z^{-i}}$$

where $\beta_i$ are the TLPCs having a predetermined degree P, $\gamma_1$ and $\gamma_2$ are acoustical weighing factor control constants selected such that $0<\gamma_2<\gamma_1 \leqq 1.0$, $\alpha_{1i}$ are the FLPCs having predetermined degree P1, and $\alpha_{2i}'$ represents the quantized signal having predetermined degree P2.

18. The coder of claim 15, wherein the response signal generator is adapted to produce a response signal which substantially adheres to the following equation:

$$x_z(n) = d(n) - \sum_{i=1}^{P} \beta_i \gamma_1^i d(n-i) + \sum_{i=1}^{P} \beta_i \gamma_2^i y_1(n-i) + \sum_{i=1}^{P1} \alpha_{1i} y_2(n-i) + \sum_{i=1}^{P2} \alpha'_{2i} x_z(n-i)$$

where d(n) is the input speech signal at zero value, $\beta_i$ are TLPCs having a predetermined degree P, $\gamma_1$ and $\gamma_2$ are acoustical weighing factor control constants selected such that $0<\gamma_2<\gamma_1 \leqq 1.0$, $\alpha_{1i}$ are the FLPCs having predetermined degree P1, and $\alpha_{2i}'$ represents the quantized signal having predetermined degree P2.

19. The coder of claim 15, wherein the delay T is determined by minimizing a distortion equation which substantially adheres to the following equation:

$$D_T = \sum_{n=0}^{N-1} x_w'^2(n) - \left[\sum_{n=0}^{N-1} x_w'(n) y_w(n-T)\right]^2 \Big/ \sum_{n=0}^{N-1} y_w^2(n-T)\Bigg]$$

where $x'_w(n)$ is the subtraction signal and $y_w(n-T)$ is the pitch prediction signal, the pitch prediction signal being equal to $v(n-T)*h_w(n)$, where $v(n)$ is the past excitation signal and $h_w(n)$ is the impulse response.

20. The coder of claim 19, wherein the pitch prediction residue signal substantially adheres to the following equation: $z_w(n)=x'_w(n)-\eta v(n-T)*h_w(n)$, where * denotes convolution and $\eta$ substantially adheres to the following equation:

$$\eta = \sum_{n=0}^{N-1} x_w'(n) y_w(n-T) \Big/ \sum_{n=0}^{N-1} y_w^2(n-T)$$

* * * * *